US005694863A

United States Patent [19]

Chen

[11] Patent Number: 5,694,863

[45] Date of Patent: Dec. 9, 1997

[54] STRUCTURE OF A PALLET

[76] Inventor: Hsiaw-Ming Chen, No. 10, Lane 44, Minchuan Rd., Taichung City, Taiwan

[21] Appl. No.: 270,674

[22] Filed: Jul. 5, 1994

[51] Int. Cl.[6] ..... B65D 19/00

[52] U.S. Cl. ..... 108/51.3; 108/51.1

[58] Field of Search ..... 108/51.3, 51.1, 108/56.1, 56.3

[56] References Cited

U.S. PATENT DOCUMENTS

| | | | |
|---|---|---|---|
| 2,501,506 | 3/1950 | George | 108/51.3 |
| 2,583,443 | 1/1952 | Perry et al. | 108/51.3 |
| 3,059,887 | 10/1962 | Ward, Jr. | 108/51.1 |
| 3,861,326 | 1/1975 | Brown | 108/51.1 |
| 4,834,001 | 5/1989 | Atterby et al. | 108/51.1 X |
| 4,863,024 | 9/1989 | Booth | 108/56.3 X |
| 4,979,446 | 12/1990 | Wincbarger | 108/51.3 |
| 5,001,991 | 3/1991 | Smith | 108/51.1 X |
| 5,076,176 | 12/1991 | Clasen | 108/51.3 |
| 5,255,614 | 10/1993 | Voss-Schrader et al. | 108/56.1 |
| 5,269,219 | 12/1993 | Juvik-Woods | 108/51.3 |
| 5,327,839 | 7/1994 | Herring et al. | 108/51.3 |
| 5,329,861 | 7/1994 | McCarthy | 108/51.3 |
| 5,411,786 | 5/1995 | Kuo | 108/51.3 X |
| 5,463,965 | 11/1995 | Cordrey | 108/51.3 |

FOREIGN PATENT DOCUMENTS

| | | | |
|---|---|---|---|
| 6503181 | 9/1966 | Netherlands | 108/51.3 |

*Primary Examiner*—Peter M. Cuomo
*Assistant Examiner*—Janet M. Wilkens
*Attorney, Agent, or Firm*—Harry I. Leon; Vivian L. Steadman

[57] ABSTRACT

A recyclable pallet includes a plurality of layers of boards securely engaged in series, each board having a plurality of protrusions projecting from an under side thereof to form a pallet with a plurality of recesses between adjacent protrusions.

3 Claims, 6 Drawing Sheets

STRUCTURE OF A PALLET

BACKGROUND OF THE INVENTION

The present invention relates to a structure of a pallet and more particularly, to a pallet comprising a plurality of layers of corrugated boards.

The most popularly-used conventional pallets have several drawbacks, the first of which is the pallet is heavy, the second is that the pallet is made of wooden planks which accelerates destruction of forests, the third is that the pallets are usually burned after having arrived in another country, which causes environmental pollution, and the fourth is that the wooden pallet tends to act as a host to germs and bugs. All of the drawbacks do not comply with economical principles.

Another kind of pallet is made of plastic materials, which provides a solution to the problem of bugs and germs received in wooden pallets, but such a plastic pallet is hard to recycle.

The present invention intends to provide a structure of a pallet which is made of corrugated boards to mitigate and/or obviate the above-mentioned problems.

SUMMARY OF THE INVENTION

The present invention provides a structure of a pallet which comprises a plurality of layers of corrugated boards commonly referred to as "corrugated cardboard", securely engaged in series and includes a plurality of protrusions projecting from an under side thereof to form a plurality of recesses between adjacent protrusions for inserting forks of a fork-lift truck.

It is an object of the present invention to provide a pallet comprising a plurality of layers of corrugated boards which can be recycled.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
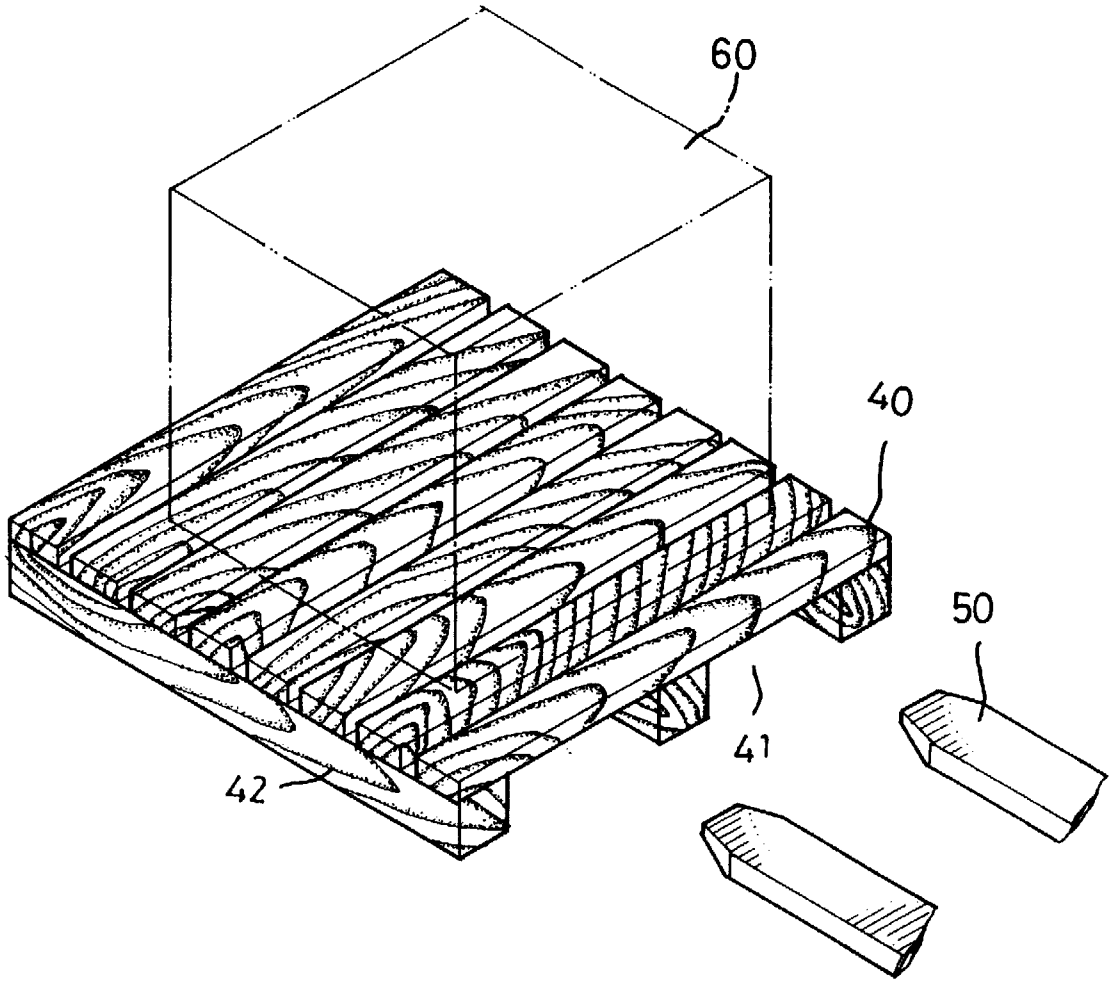
FIG. 1 PRIOR ART
FIG. 1 a perspective view of a conventional pallet.

Referring to FIG. 1, conventionally, goods 60 are moved from one place to another usually by using a fork-lift truck (partially shown). The fork-lift truck has two forks 50 extending forwardly therefrom and a lifting means (not shown) is engaged with the forks 50 so as to raise the forks 50. The goods 60 are placed on a pallet 40 before lifting them up, and the conventional pallet 40 includes a plurality of recesses 41 defined between adjacent protrusions 42 projecting from an under side thereof for convenience in inserting of the forks 50. Such a pallet 40 is made of wooden planks by nailing them together. Unfortunately, there are bugs, germs etc commonly found therein and that results in diseases such as influenza. Further, using wood to manufacture the pallets is not welcomed in current circumstances where destruction of forests and woodland is considered very harmful to the environment.

Figure 2:
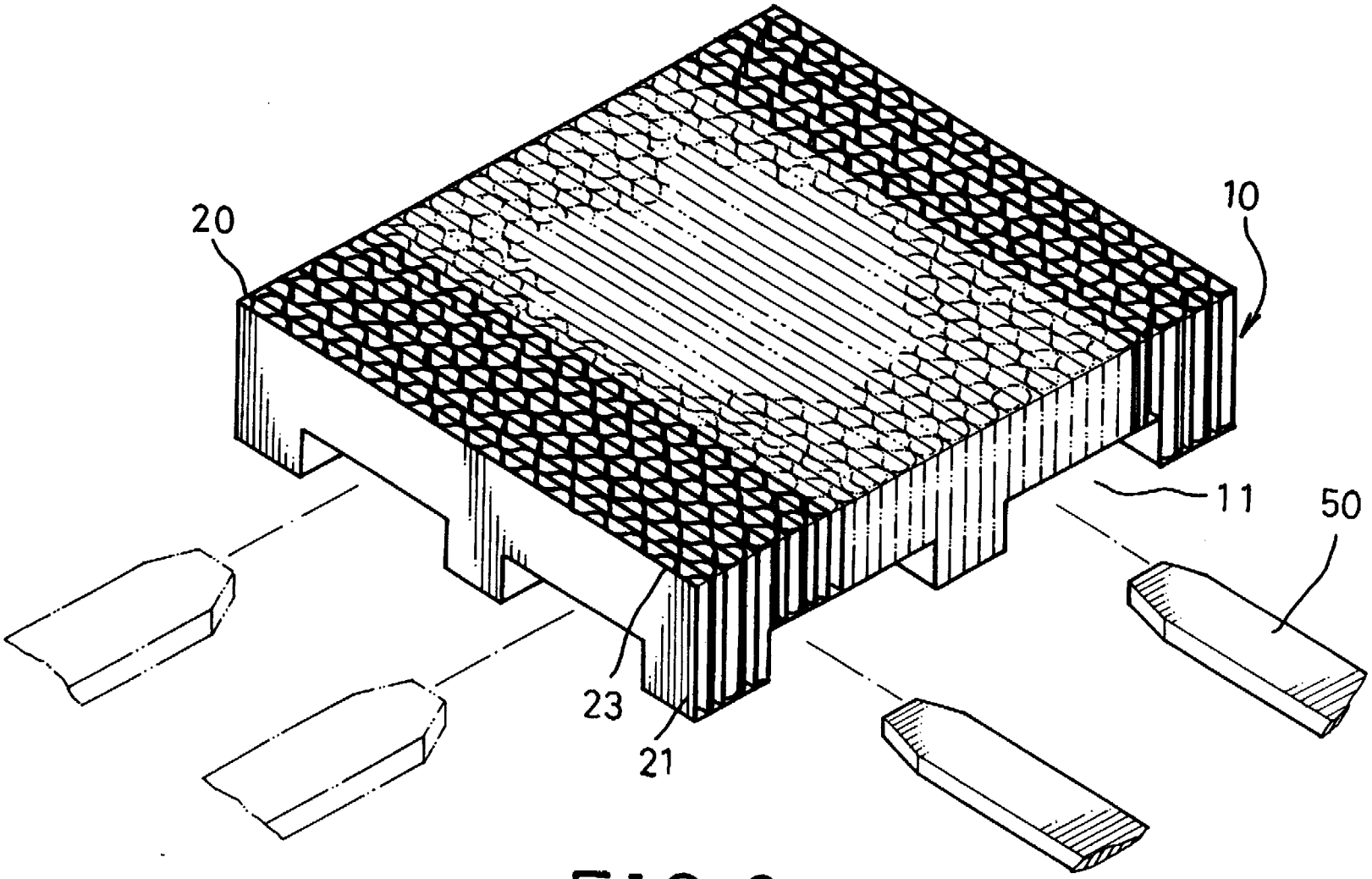
FIG. 2 is a perspective view of a pallet in accordance with the present invention.
Figure 3:
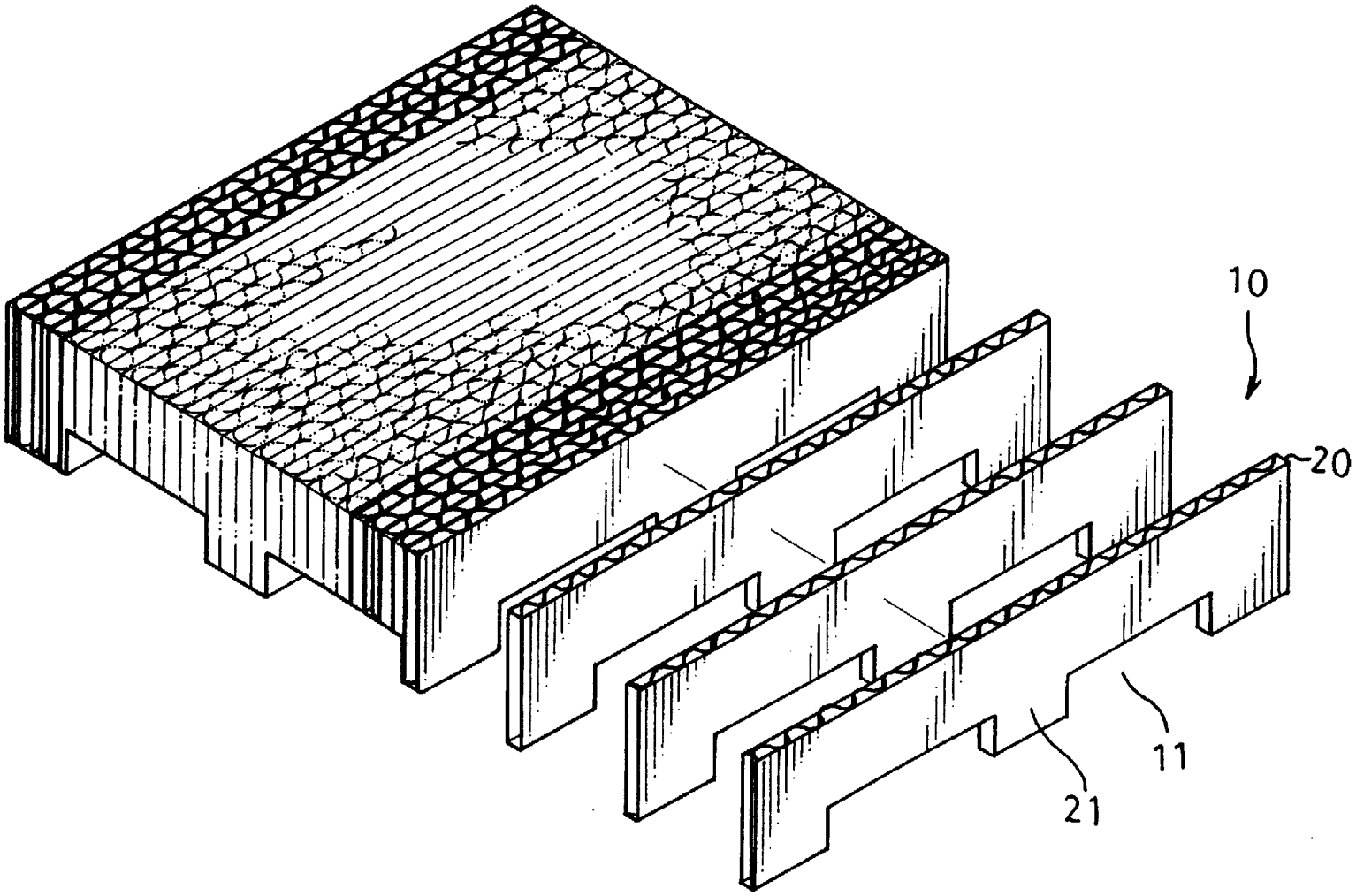
FIG. 3 is an exploded view of the pallet in accordance with the present invention.

Referring to the drawings and initially to FIGS. 2 and 3, a pallet 10 in accordance with the present invention generally includes a plurality of vertically-disposed boards of corrugated paper situated in first and second arrays, the boards having two planar faces apiece and being adhesively engaged in layers. In addition, each of the boards in the first array has generally rectangular planar faces; and each of the boards 20 in the second array defines an upper portion 23 formed integrally with two or three protrusions 21 projecting from an under side thereof to form a recess 11 between the adjacent protrusions 21. The forks 50 are then inserted in the recesses 11 of the pallet 10 to raise it.

Figure 4:
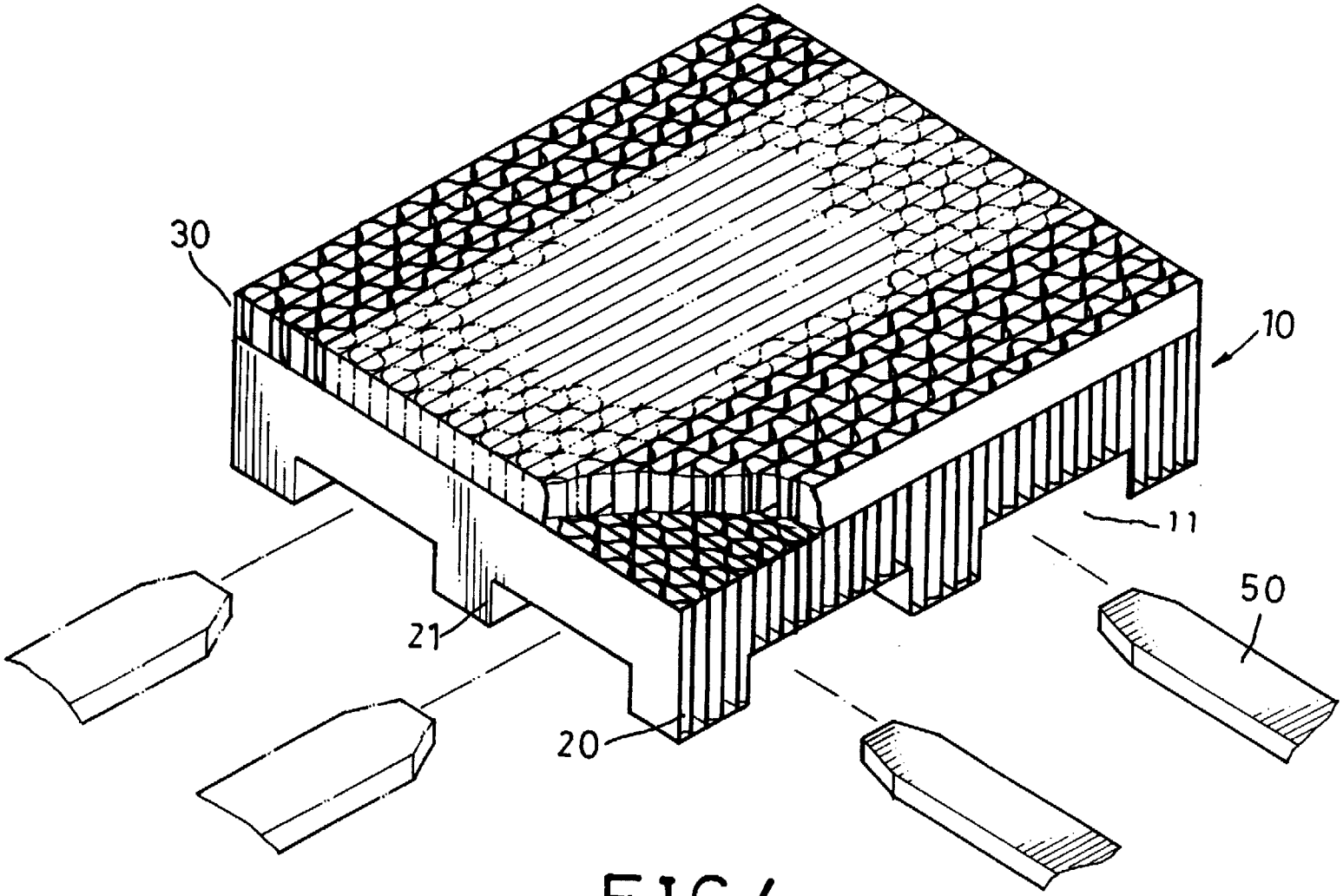
FIG. 4 is a perspective view of an embodiment of the pallet incorporated with a reinforced block.

In an alternative embodiment shown in FIG. 4, a reinforced block 30 made of vertically-disposed boards of corrugated paper which are adhesively engaged in layers, is mounted on the pallet 10 to increase the durability of the pallet 10. The orientation of each vertically-disposed board of corrugated paper in the reinforced block 30 is transverse to that of the pallet 10.

Accordingly, the pallet 10 made of corrugated boards 20 can be recycled and reused, and its weight is light compared with that of the wooden pallet. Even if the pallets are discarded, they are biogradable.

Figure 5:
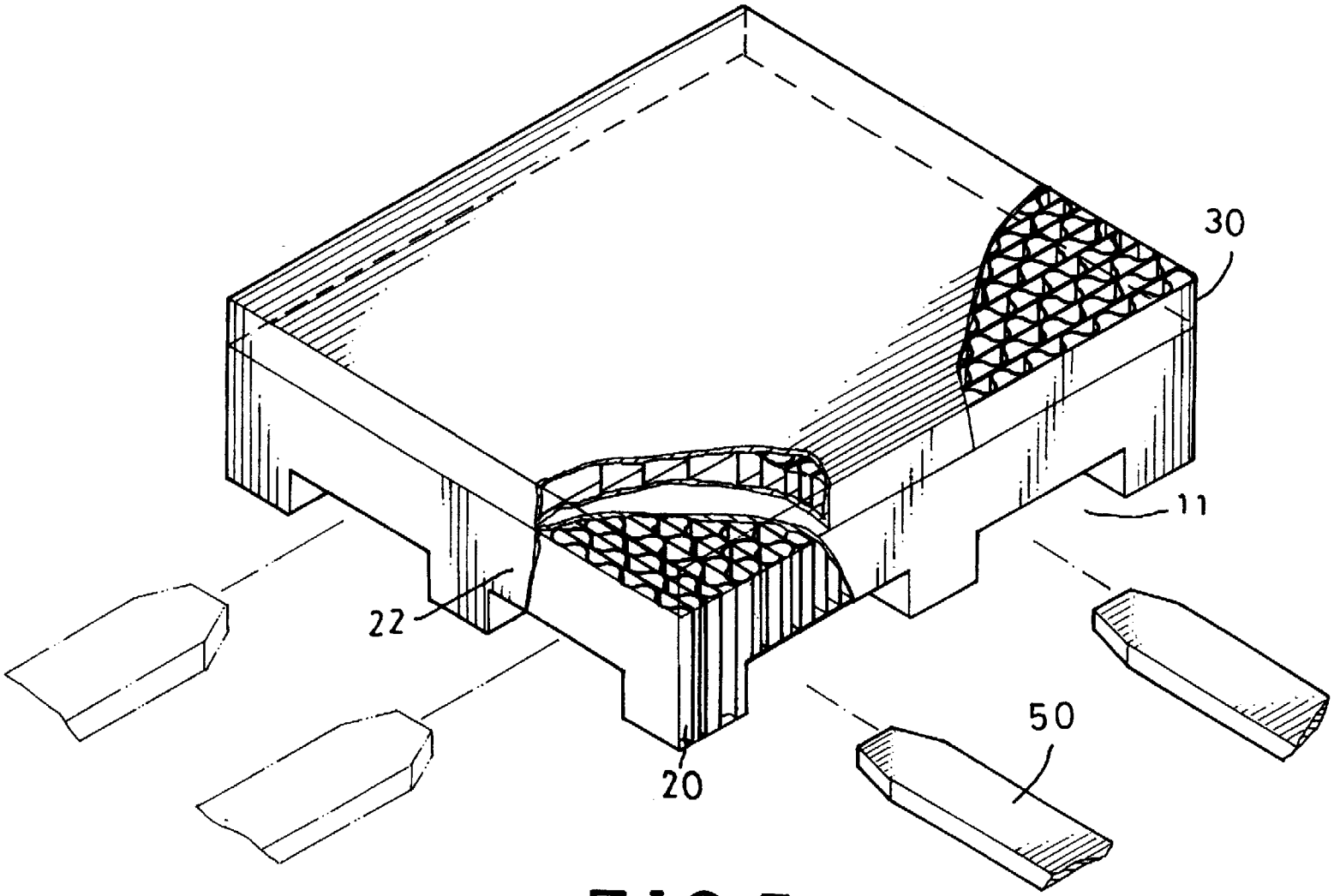
FIG. 5 is a perspective view, partly cut away, of another embodiment of the present invention.

Another embodiment of the present invention is shown in FIG. 5, a water-proof coating 22 is coated on an outer surface of the pallet 10 and the reinforced block 30, such that the pallet can be used even when it is exposed to rain.

Figure 6:
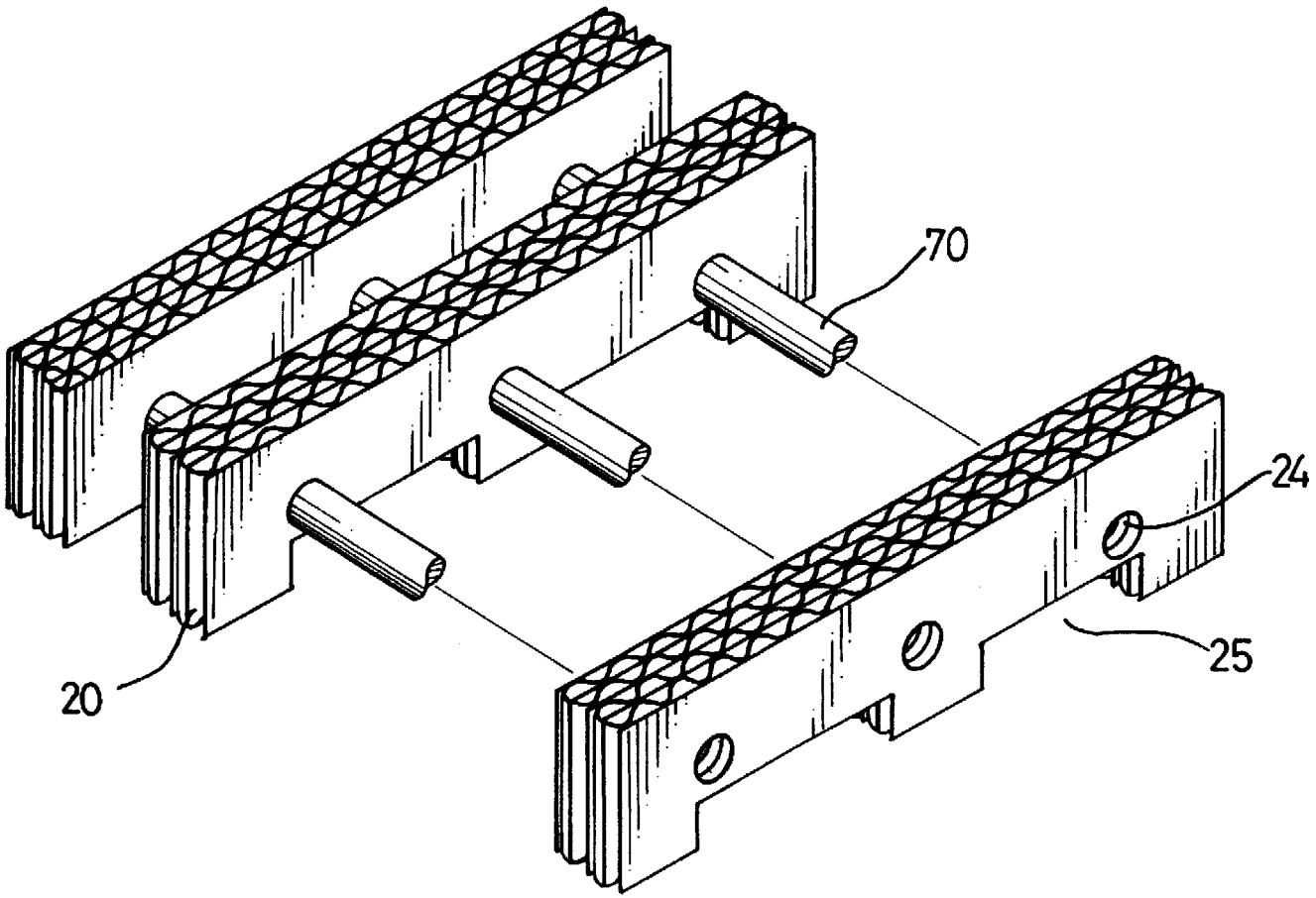
FIG. 6 is a exploded view of another embodiment in accordance with the present invention.

FIG. 6 shows an alternative embodiment which can be fabricated from fewer corrugated boards 20 than are employed in making the pallet 10. In the embodiment illustrated in FIG. 6, the pallet comprises multiple parts of vertically-disposed layers of corrugated boards which have been adhesively fastened together to form each part. Contiguous pairs of parts are spaced apart from each other. Each of these parts defines a plurality of holes 24 and recesses 25, and both the holes and recesses are alignable between contiguous pairs of parts. When the holes are properly aligned, a snugly-fitting cross tie tube 70 can be inserted therethrough and employed to position each of the parts of corrugated boards 20 so that in the assembled pallet, gaps are maintained between contiguous pairs of parts, thereby reducing the need for corrugated boards 20 in this pallet. The recesses 25 allow for the insertion of forks 50 to lift the pallet.

Although the invention has been explained in relation to its preferred embodiment, it is to be understood that many other possible modifications and variations can be made without departing from the spirit and scope of the invention as hereinafter claimed.

I claim:

1. A recyclable pallet comprising a plurality of elongated boards of corrugated paper arrayed in layers, each board having two planar faces disposed vertically, a first array of the boards having generally rectangular planar faces and a second array of the boards having planar faces of greater surface area than those in the first array and which extend downwardly therefrom, the secondary defining a plurality of protrusions projecting from an underside of the pallet, the planar faces of each contiguous pair of boards in each array being in contact with each other across substantially their entire surface areas, each contiguous pair of boards being adhesively bonded together; distal ends of the boards defining two sides of the pallet, a portion of each of the planar faces extending continuously between the two sides of the pallet; and a reinforced block made of corrugated boards which are disposed vertically, the reinforced block being adhesively mounted on said plurality of elongated boards of corrugated paper arrayed in layers.

2. The pallet according to claim 1 wherein a water-proof coating covers an outer surface of said reinforced block.

3. A pallet comprising first and second layers formed from a plurality of boards of corrugated paper, each board being disposed vertically and having at least one planar face that is substantially as wide as the pallet itself, planar faces of each contiguous pair of boards in each layer being adhesively bonded to each other to form a single, unitary structure which extends continuously, in a direction disposed transversely to the boards, between distal edges of the pallet, the second layer being adhesively mounted upon the first layer with the planar faces of the boards in the first layer being oriented generally perpendicularly to the planar faces of the boards in the second layer, the boards in the first layer together defining a plurality of protrusions which project from an underside of the pallet.

* * * * *